United States Patent [19]

Benkowski

[11] 3,949,506

[45] Apr. 13, 1976

[54] PLAQUE WITH REPOSITIONABLE ORNAMENTAL TEAM UNITS

[76] Inventor: John Benkowski, 4322 N. Leavitt St., Chicago, Ill. 60618

[22] Filed: June 12, 1974

[21] Appl. No.: 478,697

[52] U.S. Cl. ..... 40/160; 40/1.6

[51] Int. Cl.[2] ..... G09F 1/12

[58] Field of Search ..... 161/18; D29/23 A; 40/1.5, 40/1.6, 1, 63, 324, 160; 273/134 CH

[56] References Cited

UNITED STATES PATENTS

| | | | |
|---|---|---|---|
| 1,661,948 | 3/1928 | Innes | 40/63 R |
| 3,350,800 | 11/1967 | Witt et al. | 40/2.2 |
| 3,358,395 | 12/1967 | Simonovic | 40/63 R |
| 3,416,802 | 12/1968 | Montes | 273/134 CH |
| 3,726,026 | 4/1973 | Borcherding | 40/142 A |
| 3,822,494 | 7/1974 | Zivica | 40/160 X |
| D211,031 | 5/1968 | Eddy | D29/23 A |

FOREIGN PATENTS OR APPLICATIONS

| | | | |
|---|---|---|---|
| 915,360 | 7/1946 | France | 40/1.5 |

*Primary Examiner*—Louis G. Mancene
*Assistant Examiner*—Wenceslao J. Contreras
*Attorney, Agent, or Firm*—Dominik, Knechtel, Godula & Demeur

[57] ABSTRACT

An ornamental team plaque of plastic having a plurality of ornamental team unit members which are repositionably mounted on the face of a plastic body. Numerical indicators may be positioned along mounting means fixed to the plastic plaque so the selectively positioned ornamental team unit members may indicate the relative standings of the teams at any selected date, which may be indicated on the plaque.

10 Claims, 8 Drawing Figures

FIG. 1
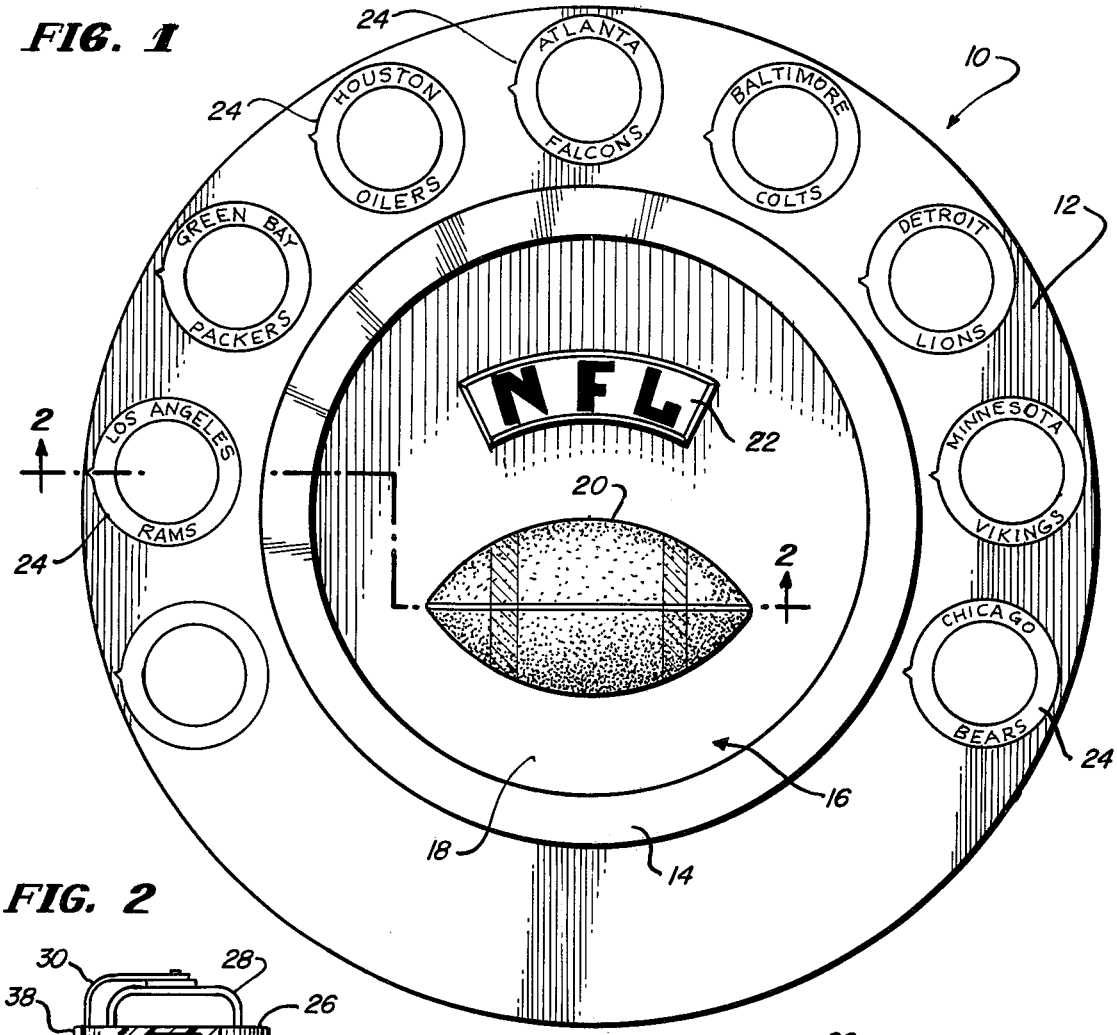
FIG. 2
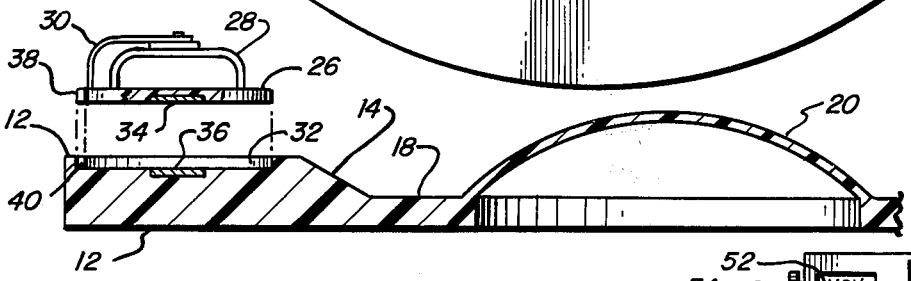
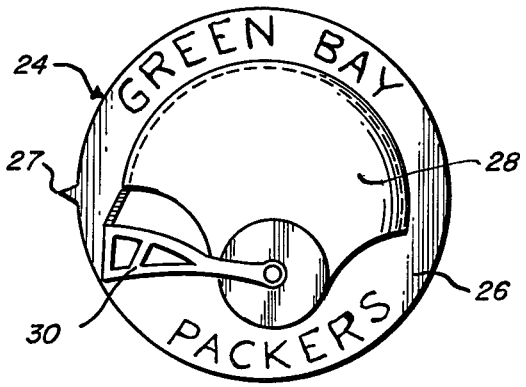
FIG. 3
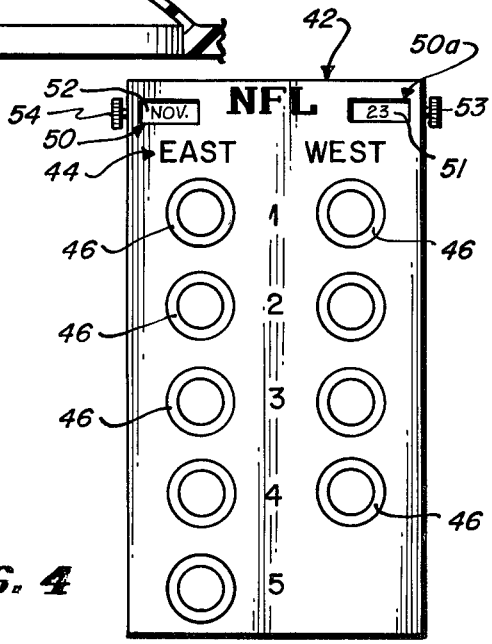
FIG. 4

FIG. 5
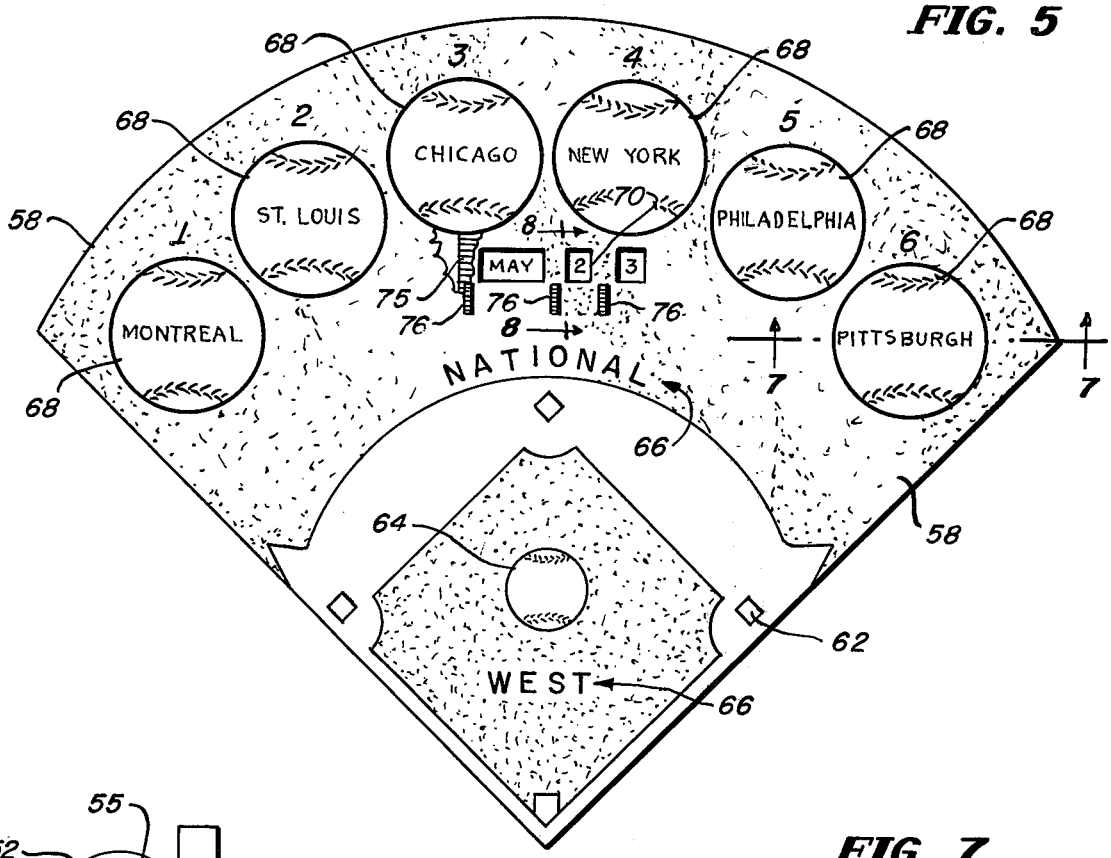
FIG. 7
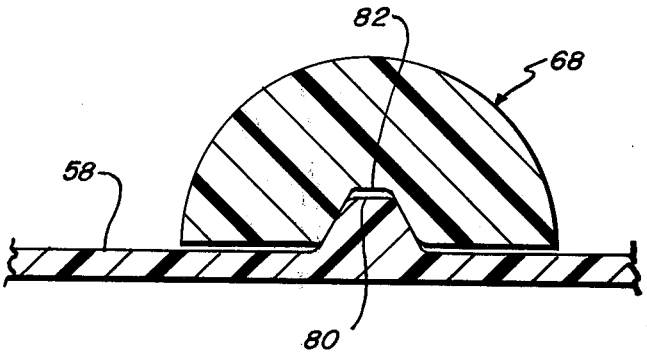
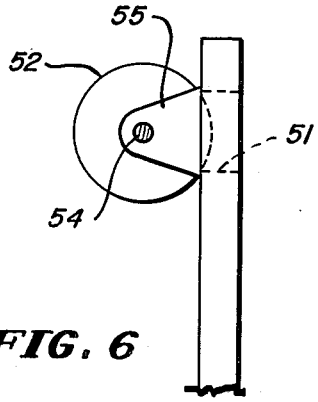
FIG. 6
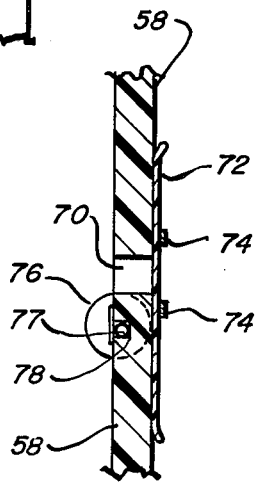
FIG. 8

PLAQUE WITH REPOSITIONABLE ORNAMENTAL TEAM UNITS

This invention relates to an ornamental plaque preferably constructed of plastic, which displays a plurality of ornamental team unit elements that may be selectively repositioned on the face of the plaque.

The invention particularly relates to an ornamental plaque wherein popular sport teams can be ornamentally represented on repositionable plastic members which can be commonly mounted and demounted on the plaque.

Sport teams have attracted immense followings, and a great deal of interest is generated in the activities and fortunes of various teams, on both the amateur and professional level. Such interest is exceptionally keen for professional teams such as football and baseball, particularly during the season of competition. Followers of the sport not only exhibit intense interest in the progress of such teams, but are also predisposed towards decorative and ornamental objects which represent such teams. As a result, emblems, pendants, photographs, artistic renditions, and the like have grown to be highly popular among the followers of such sports.

One type of ornamental or decorative article which has been introduced is the plaque which is wall mounted or table supported. Plaques have been made which, for example, display a half football helmet split along an axis from top to bottom. Such a split helmet, usually plastic, is mounted to an attractive plaque, which is often of decorative plastic. Such an ornamental boss or three dimensional depiction is attractive and has been popularly received.

It is an object of the present invention to provide an improved decorative plaque on which a plurality of distinctive team ornamentations are mounted on the face of the plaque in any one of several positions in accordance with the desires of the user of the plaque, utilizing universal mounting means.

Still yet another object of the present invention is an improved team ornament plaque of the type described in which not only may a plurality of ornamental team units be positioned at selected locations, but which further provides a series of numerical designations so that the selective mounting can correspond to team standings at any time.

Yet still another object of the present invention is a ornamental team plaque of the type described wherein attractive, raised ornamental team units may be quickly and easily demounted and remounted in accordance with selected positioning, while at the same time providing means to assure desired rotational orientation of the mounted team units on the plaque.

Yet still another object of the present invention is an ornamental team plaque of the type described wherein a plurality of ornamental team unit members may be repositioned in a numerical sequence to designate team standings or the like, while date indicator means are changed to represent such standing at any particular time period.

Yet another object of the present invention is an ornamental team plaque of the type described where, in addition to the plurality of designated ornamental team units, there is provided decorative raised means to represent a league to which the individual ornamental team units belong.

The above objects are now attained together with still other objects which will occur to practitioners from time to time by the invention of the following disclosure which includes drawings wherein:

FIG. 1 is a side elevational view of a representative ornamental plaque made in accordance with the teachings of this invention;

FIG. 2 is a portional sectional view taken along line 2—2 of FIG. 1;

FIG. 3 is a side elevational view of a representative ornamental team unit, on an enlarged scale;

FIG. 4 is a side elevational view, somewhat schematic, of an alternative embodiment illustrating mounting of individual team units in a numerical sequence to represent standings in a leaque or the like;

FIG. 5 is a side elevational view of an alternative form of a decorative plaque displaying ornamental features distinctive of baseball;

FIG. 6 is a portional view and side elevation of means to effect changeable date indication, of the type illustrated in the view of FIG. 4;

FIG. 7 is a sectional view, on an enlarged scale, taken along line 7—7 of FIG. 5; and FIG. 8 is a portional side elevational view illustrating indicator means to show different dates, of the type used in the view of FIG. 5.

Referring now to the drawings, FIG. 1 illustrates a plaque having a plastic body shown generally as 10. Such body has a face side and an opposite side. The face side includes a circular marginal area 12 which merges into downwardly tapered wall 14 which, in turn, defines a central decorative area shown generally as 16. The decorative area includes a flat portion 18 and a raised portion or ornamental boss 20 in the configuration of a distinctive representation of a sport, shown here as a football. Letter indicia are also shown at 22, raised or otherwise, to represent a league or group.

The circular margin 12 holds a plurality of repositionable ornamental team units, one of which is identified by the numeral 24. Such repositionable ornamental team units are shown as including a base 26 in a disk configuration on which is located a helmet boss 28 and a face guard member 30. Each repositionable ornamental team unit 24 is further identified by characteristic team indicia, namely, the names of the member teams of the NFL League.

Each of the team units 24 can be easily removed and remounted by engaging fixed mounting means provided on the reverse side of the team units and on the face side of the plastic body 10. The obverse side of the team unit members, of course, displays the distinctive ornamental team characteristic.

The fixed mounting means in the plastic body is illustrated herein as a plurality of sockets, one of which is identified by the numeral 32. Each socket is dimensioned to closely receive the disk 26 of the individual ornamental team units.

The mounting means on the reverse side of the ornamental team units is shown as including a magnet element 34 embedded in exposed relationship; and the mounting means in each of the sockets 32 is shown as including another magnet element 36 embedded in exposed relationship. The magnet elements 34, 36 are respectively positioned to contact each other and thereby hold the team unit member 24 in the socket 32.

The disk 26 of each team unit member is further shown as includinng an integrally formed locator element or point 38 at the circumferential edge of the disk. The socket 32 has a locator coupler or matching slot 40 located at the circumferential boundry of the socket. Engaging the point 38 in the slot 40 assures desired orientation of the team unit 24 when mounted.

The alternative plaque of FIG. 4 has a rectangular plastic body 42 and a pair of league indicia located at 44 adjacent one short side of the rectangular body. Repositionable team unit members 46 and the plastic body 42 have interchangeably engageable mounting means, which may be of the type previously described. The individual team unit members may be mounted in any one of five illustrated positions to indicate team rank or standing in their respective leagues, such numerical sequence being indicated as a ranking indicia collectively identified by 48.

The illustrated plastic body also has changeable date indicator means so that a particular date can be set to represent the illustrated standings at a given time. The changeable date indicator means is shown as including windows 51 in the plastic body, and a data wheel 52 rotatively positioned to selectively expose the month on one wheel and a calender date on the other wheel. Looking both at FIGS. 4 and 6, the changeable date indicator means is further shown as including a handle or turning knob 53 at each long side of the plastic body, and a shaft 54 fixed to each turning knob 53. The shaft is rotatably positioned in a passageway of a bracket 55 mounted to the back of the plastic body.

The ornamental plaque shown in the view of FIG. 5 relates to professional baseball, and includes a generally triangular shaped plastic body 58, one side being formed on a radius as shown. The plaque includes a raised decorative diamond configuration 60, raised bases 62, and a raised ornamental baseball boss 64. Such decorative ornamentations clearly relate to the field of baseball, and such plaque is further shown as including printed or raised letter indicia 66 to represent a baseball league. A plurality of repositionable ornamental baseball team units 68 are mounted on the face side of the plastic body, each team unit being in the shape of a raised baseball and having characteristic team indicia indicated thereon.

A numerical sequence indicating six positions is also illustrated so that the respective team units 68 may be repositioned to represent standings at any particular time. Such time is indicated by the changeable indicator means, which may bettter be seen in the portional view of FIG. 8.

The date indicator means includes window 70 in the plastic body and an elongated date strip 72 slidably positioned behind each window. Each strip date moves through a slotted guide 74. Each strip date moves through a slotted guide 74. Each strip date further has a marginal rack 75 at one side which is engaged by pinion roller 76 having fixed shaft 77 which is press fitted into slot 78 in the plastic body.

The individual team unit 68 have mounting means which interchangeably engage fixed mounting means on the plastic body 58. The mounting means on the plastic body is shown as a truncated triangular body having non-uniform dimensions, that is, being rectangular in cross section. The triangular body 80 on the plastic body engages a truncated triangular socket 82 in the reverse side of the individual team unit member 68. The triangular socket also has non-uniform dimensions which closely match the dimensions of the triangular body 80. The result is a wedging fit which not only mounts the team unit member to the plastic body, but assures correct rotational orientation of the team unit member.

The claims of the invention are now presented, and the terms of such claims may be further understood by reference to the language of the preceding specification and the views of the drawings.

What is claimed is:

1. an ornamental team plaque, including a plastic body having a face side and an opposite side, a plurality of like fixed mounting means molded with the plastic body on the face of said plastic body, a plurality of molded, oranmental team units, each of said units having a raised obverse side depicting characteristic ornamentation representative of a team, and a reverse side having like mounting means interchangeably engageable with any of said plastic body fixed mounting means so that each of said ornamental team units is repositionably mountable on any of said plastic body fixed mounting means, and indicia on the face of said plastic body to indicate league grouping of said plurality of ornamental team units.

2. An ornamental team plaque as in claim 1 which further includes changeable date indicator means on the face of said plastic body.

3. An ornamental team plaque which includes the features of claim 2 and which further includes numerical indicia sequentially presented on the face of the plastic body, and a numerical indicator positioned adjacent each of said fixed mounting means, whereby team standing may be represented for an indicated date.

4. An ornamental team plaque which includes the features of claim 1 wherein said fixed mounting means is an integrally formed socket in the plastic body, and each of said team unit members having a disk configuration to closely fit any of said formed sockets in the plastic body.

5. An ornamental team plaque which includes the features of claim 1 wherien said mounting means on a team unit member and the plastic body include cooperative locator means to selectively orientate the team unit member in mounted position on the plastic body.

6. An ornamental team plaque which includes the features of claim 1 wherein said interchangeably engageable mounting means are a magnetic element embedded in exposed relationship on the reverse side of the team member unit, and another magnetic element embedded in exposed relationship on the plastic body mounting means.

7. An ornamental team plaque assembly which includes the features of claim 4 and which further includes cooperative locator means in said interchangeably engageable mounting means, including a projecting member at the edge of said disk in the team unit member, and a matching slot in the formed socket in the plastic body.

8. An ornamental team plaque assembly which includes the features of claim 1 wherein said interchangeably engageable mounting means include a tapered body projecting from the face of said plaque and a matching tapered socket in the reverse side of said ornamental team unit, whereby a wedging fit is obtained.

9. An ornamental team plaque assembly which includes the features of claim 8 wherein said tapered projecting body and matching recess have non-uniform dimensions so that engagement results in positive orientation of the team unit member on the plastic body.

10. An ornamental team plaque assembly which includes the features of claim 1 wherein said ornamental team units include indicia distinctive for each team, and said plastic body further including a raised ornamentation distinctive for a league in which are joined said plurality of ornamental team units.

* * * * *